US005762447A

United States Patent [19]

Hachiki et al.

[11] Patent Number: 5,762,447

[45] Date of Patent: Jun. 9, 1998

[54] METHOD AND APPARATUS OF CONTINUOUSLY MEASURING HEAT QUANTITY NEED TO MELT SNOW LYING ON ROAD AND PREVENT FREEZING OF ROAD

[75] Inventors: Kunio Hachiki; Junichi Yamazaki, both of Fukuchiyama; Tadayuki Yamada, Fukui; Satoshi Yasumoto, Fukui; Masaaki Hagiwara, Fukui, all of Japan

[73] Assignee: Kohtaro Hashimoto, Fukui, Japan

[21] Appl. No.: 778,786

[22] Filed: Jan. 6, 1997

Related U.S. Application Data

[63] Continuation of Ser. No. 496,294, Jun. 29, 1995, abandoned.

[30] Foreign Application Priority Data

Jul. 6, 1994 [JP] Japan ..... 6-179587

[51] Int. Cl.[6] ..... E01C 11/26; E01H 5/10

[52] U.S. Cl. ..... 404/77; 404/71; 404/79; 219/213

[58] Field of Search ..... 404/17, 71, 72, 404/77, 79; 219/213

[56] References Cited

U.S. PATENT DOCUMENTS 4,305,681 12/1981 Backlund ..... 404/77 X 5,062,736 11/1991 Katsuragi et al. ..... 404/72

FOREIGN PATENT DOCUMENTS 63-274838 11/1988 Japan .

2-173536 7/1990 Japan .

5051910 3/1993 Japan ..... 404/71

5051911 3/1993 Japan ..... 404/71

5065702 3/1993 Japan ..... 404/71

*Primary Examiner*—James Lisehora

*Attorney, Agent, or Firm*—Nikaido Marmelstein Murray & Oram LLP

[57] ABSTRACT

In order to provide an integral whole unit for continuously measuring the quantity of heat needed to melt snow lying on a road, and prevent freezing of the road; and for controlling a supply of heat to the road for melting the snow lying on the road and for preventing the freezing of the road, it uses a road-simulated device. The road-simulated device is put outdoors while it is snowing, and it is heated and kept at a temperature of −0° C., thus keeping the road-simulated surface free of snows, and preventing the freezing of the road-simulated surface. In this condition the thermal energy required to keep the simulated road surface unfrozen is determined, and every control variable is determined on the basis of this so determined thermal energy.

1 Claim, 4 Drawing Sheets

METHOD AND APPARATUS OF CONTINUOUSLY MEASURING HEAT QUANTITY NEED TO MELT SNOW LYING ON ROAD AND PREVENT FREEZING OF ROAD

This application is a continuation of application Ser. No. 08/496,294, filed Jun. 29, 1995, now abandoned.

BACKGROUND OF THE INVENTION

1. Field of the Invention

The present invention relates to the art of keeping road free of snows, and of preventing freezing of the road in winter, and more particularly the art of determining the quantity of heat needed to melt snow lying on the road in ceaselessly changeable weather condition, and of determining the quantity of heat needed to prevent the freezing of the road while it is snowing and after it has stopped snowing. Also, the present invention relates to the art of providing useful pieces of information available for permitting the making of a timely decision of scattering anti-freezing agent on the road.

2. Description of Related Art

The removing and/or melting of the snow lying on the road is useful in preventing the road from freezing in winter. The removing and/or melting of the snow lying on the road can be effected by scattering water or anti-freezing agent over the road or by raising the temperature of the road with the aid of boiled-water pipes or electric heating wires buried under the road. These approaches necessitate the making of decision at correct moment, depending on reliable information sources. As for the latter approach the road must be heated to raise its temperature high enough to melt snows and prevent the freezing of the road. From the economical point of view the quantity of heat needed to keep the road free of snow must be correctly determined.

To obtain required pieces of information such as detection of the falling of snow or determination of the quantity of snowfall, infrared rays are used. The falling of snow can be detected at the beginning by intercepting the infrared rays or by permitting the infrared rays to reflect from the falling flakes of snow. The quantity of snowfall can be determined in terms of the number of interceptions or reflections of the infrared rays by the falling flakes of snow.

As for detection of the freezing of the road the temperature of the road is determined according to a contact or non-contact temperature measuring method, and the freezing can be detected in terms of the descent of temperature below the freezing point. Japanese Patent 63-274838(A) discloses the use of a road-simulated surface, which is kept wet all times, and freezing is detected in terms of the electric conductivity of the wet road-simulated surface. To control the melting of the snow lying on the road the temperature of the steam or hot water is determined after circulating it under the ground to melt the snow, and the quantity and/or temperature of the steam or hot water is controlled in terms of the quantity of lost heat thus determined. Japanese Patent 2-173536(A) discloses the use of a thermal gauge for determining the quantity of heat needed to melt the snowfall on the a road.

A matter of great concern in road conditioning installation is to prevent the freezing of the road after washing and removing snows away from the road. The unfreezing of the road is increasingly difficult with an increase of the scale of the road conditioning installation, and correspondingly the increase of the area of the road under the supervision of such large-scaled road conditioning installation. To prevent the freezing of the road, the scattering of water is stopped when the atmospheric temperature falls. If the temperature falls during the scattering of water, the scattering of water is continued until the temperature rises.

As for the former the snow lying on the road cannot be removed, and as for the latter a lot of water will be wasted. The wasting of water may cause depletion of underground water, which is used as a water source for removing snows by scattering water.

As for detection of road freezing in terms of the electric conductivity of the wet surface of a road-simulated plane, such detection is liable to be delayed because of the roofing over the road-simulated plane to shield it from snow, accordingly which presses the heat loss by radiation. Thus, it cannot detect the beginning of the freezing of the road. The difficulties of detecting the start of freezing of the road are partly attributable to the complexities of road cooling phenomena by radiation as for instance as follows: the road is most liable to be frozen at night under a cloudless sky; when the temperature falls close to 0° C., and the sky is closed thick with clouds, there will be much snow; and as the sky is less cloudy, the snow falls less and less; when it stops snowing and when the sky is almost cloudless, heat will be quickly lost from the road by radiation to cause the gradual fall of the atmospheric temperature; no road freezing will be caused when the sky is so cloudy that it looks like snow; when the sky is thick with clouds and when it is snowing, the atmospheric temperature ranges from +1° C. to −4° C., causing no freezing of the road.

When stars begin to appear in the sky after the snowing, stops the road is easily frozen, and when the sky is less cloudy, sudden freezing is caused even at a temperature of +1° C. This reveals the fact that the freezing cannot be detected only with recourse to the measuring of the atmospheric temperature.

The transformation from water to ice can hardly be detected from a consideration of the temperature of the road surface. As a matter of fact, such detection is even impossible if the temperature of the road surface is measured with the aid of a non-contact temperature gauge; the temperature at which a the determination of freezing is made must be set, in fact, above 0° C. in consideration of errors appearing in measuring devices.

In case of scattering water on the road for removing snows from the road water cannot be scattered evenly, and therefore the temperatures detected at selected measuring points cannot represent the road condition accurately, and therefore, the road conditioning installation cannot be appropriately controlled so far as it relies on such temperature detection.

On-and-off controlling type of snow sensors are used for detecting the snow lying on the road as a function of the falling of snow. These detectors work before snow lies on the road, and therefore, they are liable to give false readings when it is snowing at a relatively high temperature, or when it is snowing lightly. Also, it may be falsely affected by mist, insects or falling leaves. Even if such on-and-off controlling type of snow sensors works correctly, the road conditioning installation is not permitted to supply heat in a continuously controlled fashion. Disadvantageously such non-adaptive heating control tends to waste thermal energy when the heating capability is large compared with the quantity of snow lying on the road, or it stops heating prior to removal of snows from the road when the heating capability is small compared with the quantity of snow lying on the road.

With respect to detection of the temperature of the steam or hot water returning after heating the road required control is made with the temperature of the returning boiled water kept at a given positive value because the quantity of the latent heat contained in water at 0° C. cannot be determined, and therefore waste of thermal energy is inevitable. Japanese Patent 2-173536(A) provides the art of controlling the quantity of heat needed to melt the snow lying on the road, but it is not capable of detecting snow lying on the road at the beginning of snow fall, nor can it detect the freezing of the road. Conventional sensors are unable to store data pertaining to the condition of snowfall, and/or the melting of snows by heating or the freezing of the road, and therefore no useful data are available for references and investigations for designing of road conditioning installations and for energy and water-source saving projects.

SUMMARY OF THE INVENTION

The road conditioning installation must be controlled to supply the quantity of heat needed to just melt the snow lying on the road and to prevent freezing of the road. If not, an extra quantity of heat would be supplied and wasted, or an insufficient quantity of heat would be supplied which would permit snows to remain on the road or permit the road to be frozen.

In view of this one object of the present invention is to provide an integral whole unit for continuously measuring the quantity of heat needed to melt the snow lying on the road and to prevent freezing of the road, and for controlling the supplying of the heat to the road for melting the snow lying on the road and for preventing the freezing of the road.

Another object of the present invention is to provide a method of preventing the freezing of the road surface without wasting thermal energy.

These objects can be attained according to the present invention by: putting a road-simulating device outdoors while it is snowing; heating and thereby keeping the road-simulating device at a temperature of −0° C., thus preventing the freezing of the road-simulated surface; measuring the thermal energy needed to prevent the freezing of the road-simulated surface; and determining every control variable on the basis of the so determined thermal energy.

Specifically an integral whole unit for continuously measuring the quantity of heat needed to melt the snow lying on the road and prevent the freezing of the road, and for controlling the supply of the heat to road for melting the snow lying on the road and for preventing the freezing of the road, is improved according to the present invention in that it comprises: a thermal quantity measuring device comprising a snow-receptor plane of a material which provides a simulation of a road surface, having electric heaters and temperature sensors embedded therein, means for detecting the falling of snow and the amount of snow lying on the snow-receptor plane, and means for determining the water content of snow; means to control the supplying of electric power to the electric heaters of the snow-receptor plane, thus generating the quantity of heat needed to keep the snow-receptor plane at −0° C., and keeping the snow-receptor plane free of snow; a central processor unit responsive to different signals from the thermal quantity measuring device for determining the quantity of heat needed to melt the snow lying on the snow-receptor plane while keeping the snow-receptor plane at −0° C., and means to control an associated road conditioning installation in terms of the so determined quantity of heat needed to melt the snow lying on the snow-receptor plane.

A method of preventing the freezing of the road surface is improved according to the present invention in that it comprises the steps of: a) putting a road-simulated plate outdoors; b) measuring the quantity of heat needed to keep the road-simulated plane at −0° C., thus keeping it free of snow; c) determining the quantity of heat needed to prevent the freezing of the road in terms of the quantity of heat measured at step (b); and d) controlling a road conditioning installation to supply the thermal energy to the road for keeping the road in unfreezing condition.

The road-simulated surface may be made of a material whose thermal capacity and thermal conductivity are nearly equal to those of asphalt or any other pavement material, thereby permitting the road-simulated surface to behave like an actual pavement surface when exposed to the heat radiated by the sun, the cooling caused by heat radiation from the ground and other weather conditions. The road-simulated surface may be lined with a heat insulation material to prevent loss of heat from the bottom of the simulated pavement. The temperature of −0° C., is a temperature below, but close to 0° C.

Means for detecting the falling of snow and the snow lying on the snow-receptor plane may be photoelectric devices. Photoelectric devices for detecting the falling of snow may be placed on the road-simulated surface whereas photoelectric devices for detecting the snow lying on the road-simulated surface may be place d at a level somewhat higher than the road-simulated surface. Means for determining the water content of snow may have a heating unit equipped therewith.

The arithmetic section of the central processing unit determines the quantity of electric power that must be supplied to the electric heaters in operative relationship to the road-simulated surface, which quantity of electric power is just what is needed to keep the road-simulated surface at a temperature of −0° C., thereby keeping it free of snow, and then a arithmetic section converts the determined electric power into a quantity of heat (calories), which is outputted as an unfreezing heat quantity signal "B", which represents the quantity of heat needed to prevent the freezing of the road. The road conditioning installation is responsive to an unfreezing operation command signal "H" for running, and the road conditioning installation is responsive to a signal representing an installation capability controlling value "D" (i.e. the ratio of the unfreezing heat quantity signal "B" to the maximum heating capability of the road conditioning installation) for supplying an adequate quantity of heat to the road for preventing the freezing of the road.

As for determination of the quantity of heat needed to melt the snow lying on the road, a snowfall sensor signal "E" appears upon simultaneous appearance of a snow flake signal "a", a simulated-road temperature signal "d" and an atmospheric temperature signal "d" each exceeding certain limits. A snow lying sensor signal "F" and a snow-melting operation command signal "G" are outputted upon simultaneous appearance of the snowfall sensor signal "E", a snow lying signal "c" and a water content signal "i", and electric power is supplied to the electric heaters upon simultaneous appearance of these signals. Then, the quantity of electric power is determined and converted to calories, providing a snow-melting heat quantity signal "C".

Other objects and advantages of the present invention will be understood from the following description of a heat quantity measuring section of a road conditioning installation according to one preferred embodiment of the present invention, which heat quantity measuring section is shown in accompanying drawings.

DESCRIPTION OF THE PREFERRED EMBODIMENTS

Figure 1:
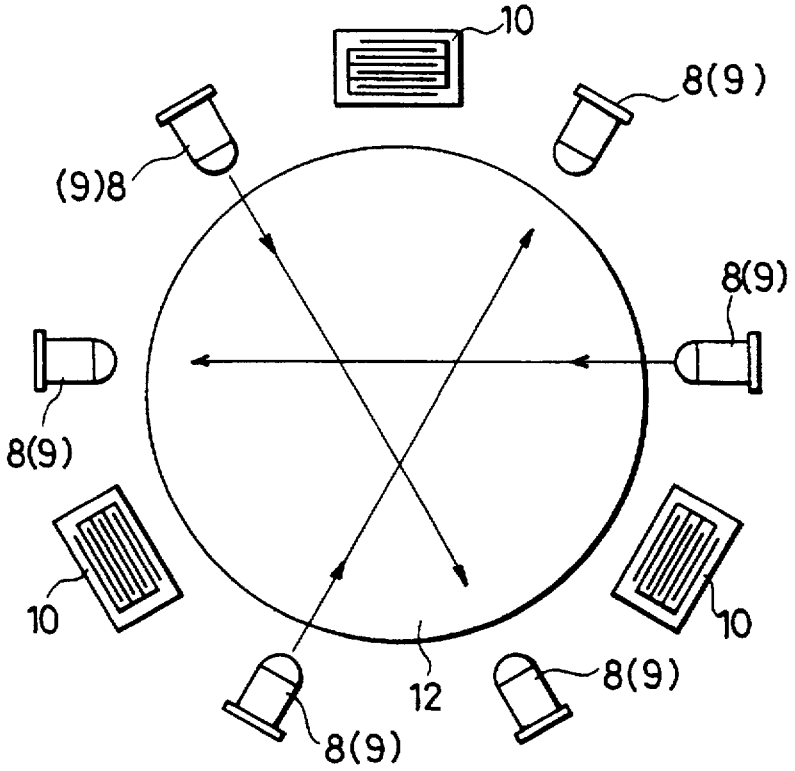
FIG. 1 is a plane view of the heat quantity measuring section.
Figure 2:
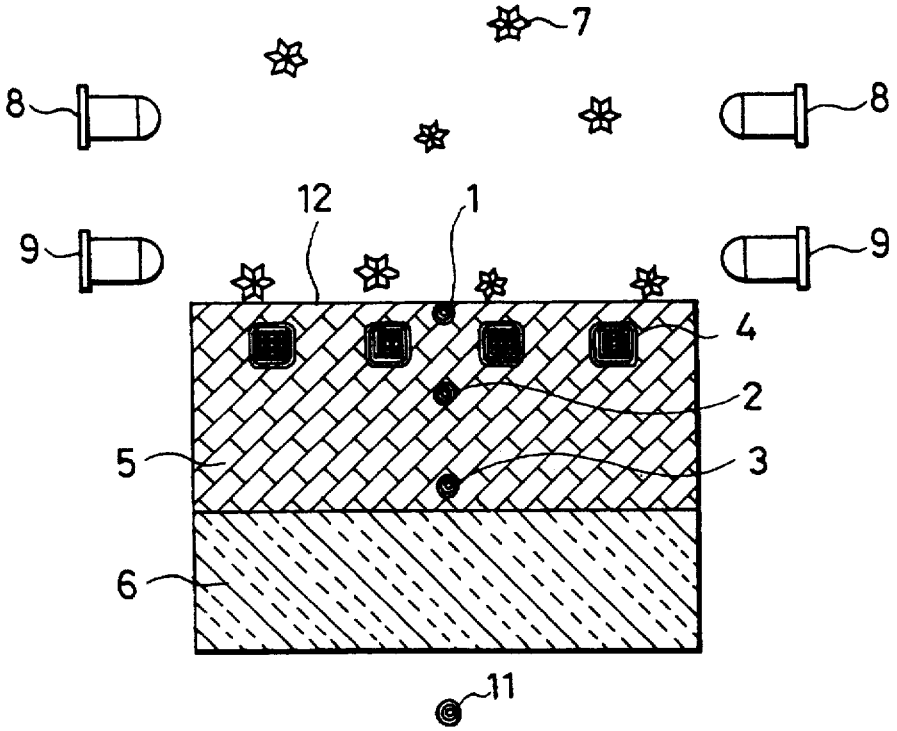
FIG. 2 is a longitudinal section of the heat quantity measuring section.

Referring to FIGS. 1 and 2, a heat quantity measuring device comprises a snow-receptor plane 12 of a material which simulates a road surface, snow-flake detecting sensors 8, and snow-lying detecting sensors 9 encircling the snow-receptor plane 12. As shown in FIG. 1, these sensors are arranged in opposing relationship. Also, water-content gauges 10 are arranged around the snow-receptor plane 12 at regular angular intervals. As shown in FIG. 2, the snow-receptor plane 12 has a road-surface simulating layer 5 lined with a thermal insulator 6. The road-surface simulated layer 5 has temperature gauges 1, 2 and 3 embedded at upper, intermediate and lower levels. Also, it has electric heaters 4 embedded close to its surface.

The temperature of the surface of the snow-receptor plane 12 is measured continuously by the temperature gauge 1 ("d" in FIGS. 3 and 4), and electric power to the electric heater 4 ("e" in FIGS. 3, 4 and 5) is controlled so that the surface of the snow-receptor plane 12 may be kept at a given constant temperature, for example around −0° C. The electric power needed to keep the surface of the snow-receptor plane 12 at the temperature of −0° C. is converted into calories, and the so converted value can be used in estimating quantity of heat needed to keep the actual road in unfreezed condition.

The Manner of Detecting the Falling of Snow at the Beginning

Figure 3:
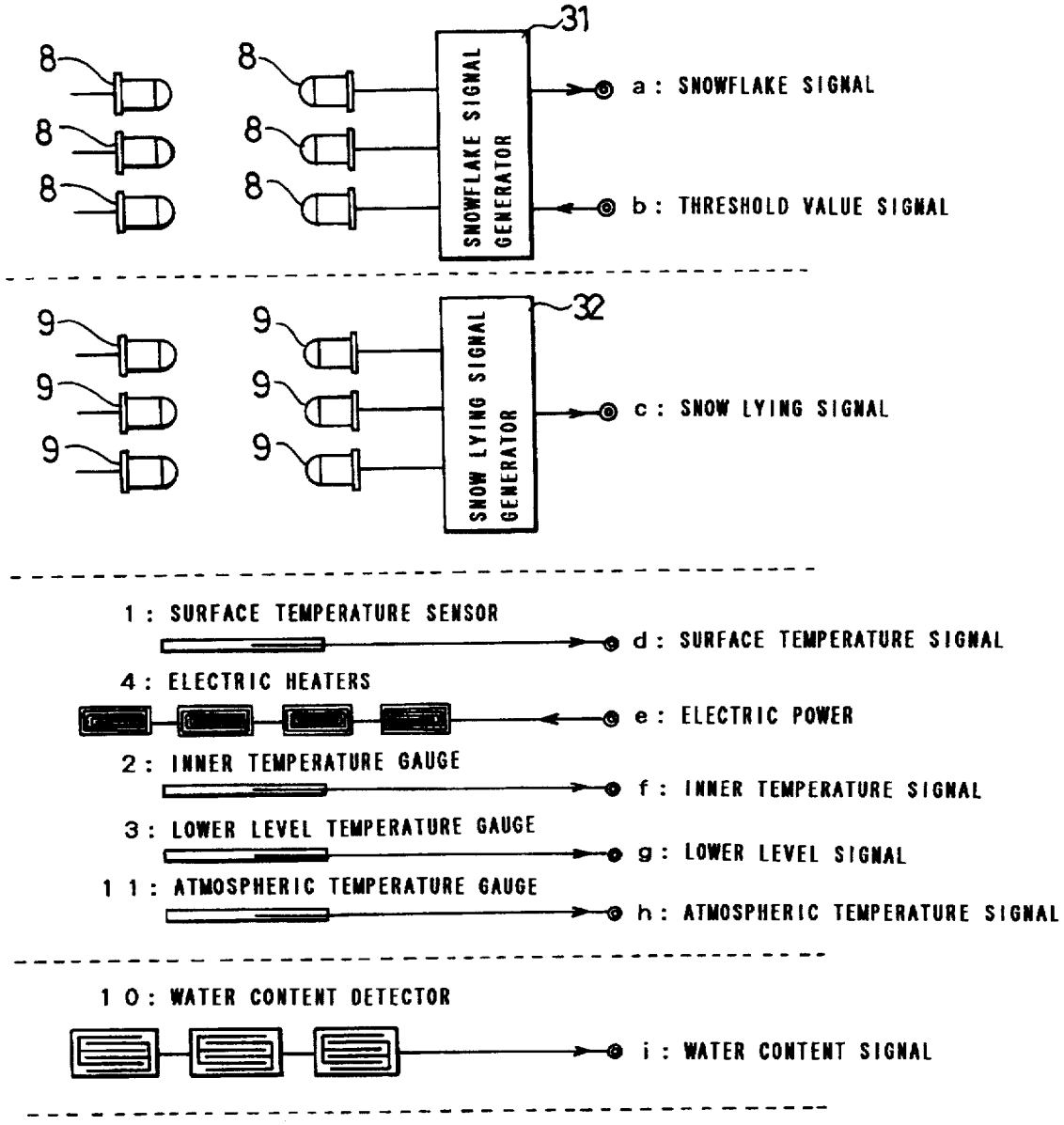
FIG. 3 shows diagrammatically what signals are provided by which parts of the heat quantity measuring section.
Figure 4:
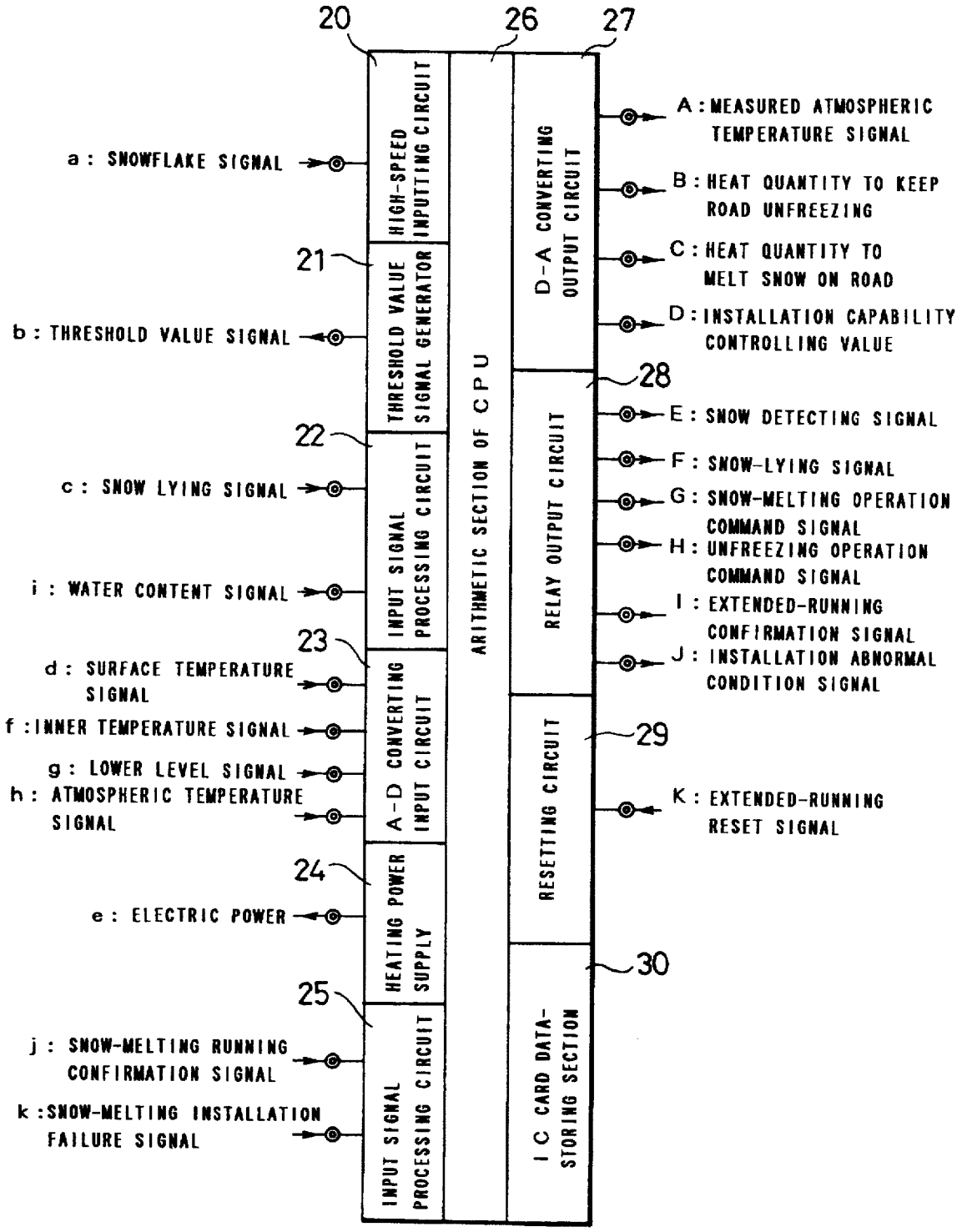
FIG. 4 shows diagrammatically what signals are provided in a central processing unit.

The flakes of snow 7 can be detected by intermittently intercepting the light to the snow-flake detecting sensors 8 ("a" in FIGS. 3 and 4). A snow-flake signal generator 31 is connected to the snow-flake detecting sensors 8 (FIG. 3). In the snow-flake signal generator 31 the optical signal from the snow-flake signal generator 31 is converted into an electric signal representing the quantity of falling flakes of snow; the amplitude of the so converted electric signal is compared with a given threshold value ("b" in FIGS. 3 and 4) to make a decision as to whether it is above the threshold value or not; and then, in the affirmative case, the signal generator provides a snow-flake signal of "HIGH" ("a" in FIGS. 3 and 4).

A high-speed inputting circuit 20 in the arithmetic section of the central processing unit 26 (FIG. 4) determines how long incoming snow-flake signals ("a" in FIGS. 4 and 5) last by counting the snow-flake signals, provided that each snow-flake signal is found to have a predetermined duration. The counted value is compared with a predetermined value in the arithmetic section of the central processing unit 26, and when the counted value is found to exceed the predetermined value, a snow detecting signal E is outputted, indicating the start of falling snow ("E" in FIGS. 4 and 5).

The Manner of Detecting the Lying of Snow

Figure 5:
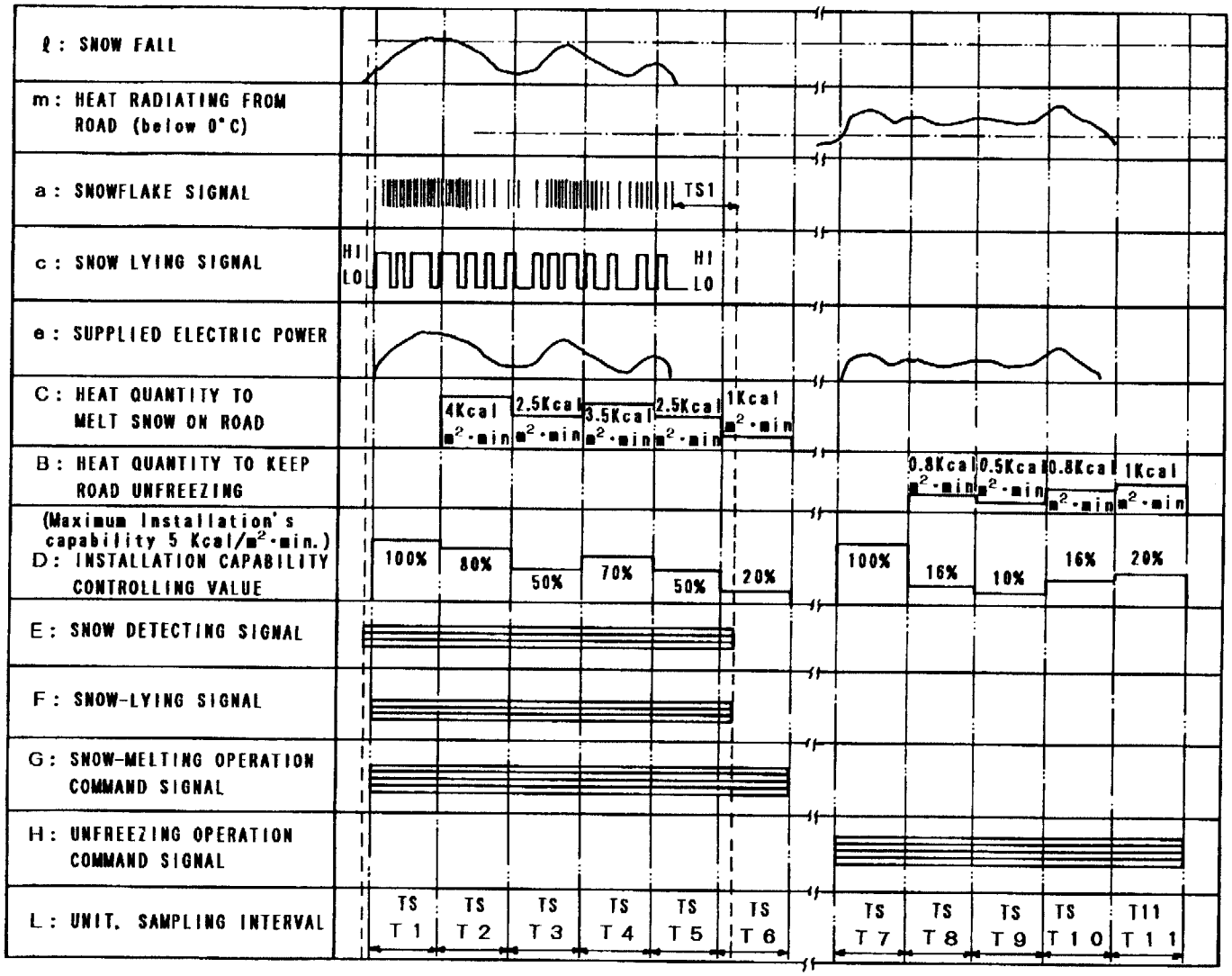
FIG. 5 shows diagrammatically what signals are processed and how such signals are related in the central processing unit.

Assume that the snow is lying on the surface of the snow-receptor plane 12 until the light to the snowfall detecting sensors 9 are intercepted ("C" in FIGS. 3, 4 and 5). A snow-lying signal generator 32 is connected to the snowfall detecting sensors 9 (FIG. 3). When the light to the snowfall detecting sensors 9 is intercepted, the snow-lying signal generator 32 sends a snowfall signal "c" of "HIGH" to an input signal processing circuit 22 (FIGS. 3 and 4). In addition to confirmations of arrival of the snowfall signal "c" and the water content signal "i" (FIG. 3), the arithmetic section 26 of the central processing unit makes decisions as to: (1) whether or not the atmospheric temperature detected by a temperature gauge 11 is within the temperature range in which it can be snowing, and (2) whether or not the temperature of the surface of the snow-receptor plane 12 measured by the temperature gauge 1 is within the temperature range in which snow can lie on the snow-receptor plane 12. In the affirmative cases the central processing unit permits an associated power supply 24 to send required electric power "e" to the electric heaters 4 of the road simulated device 12, and at the same time, a snow lying signal "F" is outputted (FIGS. 4 and 5).

The Manner of Determining the Heat Needed to Melt the Snow Lying on the Road-Simulated Device The electric power "e" which has been supplied to the electric heaters 4 of the road-simulated device 12 is integrated while the snowfall signal "c" remains at "HIGH", and the so integrated electric power is converted into calorie. This value indicates the quantity of heat needed to melt the snow lying on the actual road. The quantity of heat "B" needed to keep the actual road in unfreezing condition and the quantity of heat "C" needed to melt the snow lying on the actual road can be calculated as follows.

The quantity of heat provided by the electric heaters 4 in the form of electric power is calculated for each of sequential sampling intervals "L" (FIG. 5). In case of calculating the quantity of heat needed to keep the road in unfreezing condition the first sampling interval begins with the supplying of electric power "e" to the electric heaters 4 for keeping the surface of the snow-receptor plane 12 at the temperature of −0° C. (so that the temperature of the snow-receptor plane 12 given by the surface temperature signal "d" may be kept at the temperature of −0° C. in FIGS. 3 and 4), whereas in case of calculating the quantity of heat needed to melt the snow lying on the road the first sampling interval begins with the supplying of electric power "e" to the electric heaters 4 after appearance of the snowfall signal "c" of "HIGH" (FIGS. 3 and 4). The electric power supplied to the snow-receptor plane 12 is converted into calorie for each sampling interval TS (FIG. 5), and the thermal value is divided by the time length of the sampling interval to provide a thermal quantity of calorie per minute. Finally, this value is divided by the area of the snow-receptor plane 12 (square meters). Thus, the reference value of the quantity of heat needed to prevent the freezing of the road or melt the snow lying on the road can be given in terms of Cal./min. $m^2$.

The anti-freezing heat quantity can be distinguished from the snow-melting heat quantity as follows: the electric power supplied to the electric heaters 4 while the snowfall signal "c" of "HIGH" appears is used to calculate the snow-melting heat quantity whereas the electric power supplied to the electric heaters 4 to keep the snow-receptacle plane 12 at the temperature of −0° C. is used to calculate the anti-freezing heat quantity.

As for the continuity of the snow detecting signal E the signal-to-signal interval varies with the degree of heaviness when it is snowing. The signal continues if the signal-to-signal interval remains the sampling duration TS, and if the signal-to-signal interval exceeds the sampling duration TS, the signal disappears.

As for the continuity of the snow lying signal "F" the signal begins when the snowfall signal "c" of "HIGH" appears, and when the prescribed weather and thermal conditions are satisfied to supply the electric power as described earlier, and the signal "F" ends with disappearance of the snow detecting signal E.

Installation capability controlling value D is defined as the ratio of unfreezing heat quantity "B" plus snow-melting heat quantity "C" to the maximum heat quantity available (per minute per square meters), and such installation capability controlling value D is given by the central processing unit 26. This value D is recalculated for each sampling interval TS (FIG. 5). At the first sampling interval T1 or T7, however, the unfreezing heat quantity "B" and snow-melting heat quantity "C" cannot be obtained. At the outset the installation capability controlling value D is estimated to be 100%. This has the effect of the road being guaranteed to be free of snows at the outset.

If the installation capability controlling value D increases beyond one, the extra quantity exceeding one indicates the degree of shortage of the heat quantity supplied by the road conditioning installation, and then the extra quantity exceeding one is added to the next calculation result at the following sampling interval to provide a correct installation capability controlling value D.

Assume that the quantity of heat needed to melt the snow lying on the ground or prevent the freezing of the road exceeds the heating capability of the installation. Then, the extended running results inevitably. The extended running can be made to stop by generating a reset signal "K" by an operator.

The central processing unit provides atmospheric temperature signal "A", simulated-road temperature signal "d", intermediate-level temperature signal "f", lower-level temperature signal "g", unfreezing heat quantity signal "B", snow-melting heat quantity signal "C", installation capability controlling value "D", snowfall sensor signal "E", snow lying sensor signal "F", snow-melting operation command signal "G", unfreezing operation command signal "H", extended-running confirmation signal "I", snow flake count-and-water content signal "i", road-surface temperature signal "d", inner temperature signal "f", snow-melting running confirmation signal "J", snow-melting installation failure signal "k" and other signals. These signals along with time and days of the calendar are recorded in integrated circuit cards at each sampling interval. Also, the values set in the central processing unit 26 are recorded every time such values are reset.

We claim:

1. A method of preventing freezing of a road surface which comprises the steps of:

a) disposing a thermal quantity measuring device outdoors in ambient conditions, which device comprises:
a road-simulating plane;
electric heaters and temperature sensors embedded in said road-simulating-plane, respectively at upper, intermediate and lower levels;
a further temperature sensor adapted to detect atmospheric temperature;
means for detecting falling of snow and for detecting snow lying on the road-simulating plane, and
means for determining the water content of the snow on said plane by melting the snow;

b) supplying sufficient electric power to said electric heaters to keep said road-simulating plane unfrozen at −0° C. under said ambient conditions;

c) from the amount of said supplied electric power, determining a quantity of heat needed to prevent freezing of the road-simulating plane, which is equal to the quantity of heat needed to keep the road-simulating plane at −0° C.;

d) disposing a road conditioning installation in operative association with a road under said ambient conditions; and e) controlling said road conditioning installation, relative to said quantity of heat determined in step c), to supply thermal energy to a surface of said road sufficient to keep the road in an unfrozen condition.

* * * * *

UNITED STATES PATENT AND TRADEMARK OFFICE

CERTIFICATE OF CORRECTION

PATENT NO. : 5,762,447

DATED : June 9, 1998

INVENTOR(S) : Hachiki et al.

It is certified that error appears in the above-identified patent and that said Letters Patent is hereby corrected as shown below:

On title page,

Item [73], please delete "Fukui" insert therefor -- Osaka --

Item [73], please insert -- Yamada Technica Corporation, Fukui-Shi, Japan -- after "Japan".

Signed and Sealed this

Third Day of November, 1998

*Attest:*

*Attesting Officer*

BRUCE LEHMAN

*Commissioner of Patents and Trademarks*